United States Patent [19]

Oda et al.

[11] 4,290,859

[45] Sep. 22, 1981

[54] PROCESS FOR PREPARING ELECTRODE

[75] Inventors: Yoshio Oda; Hiroshi Otouma; Eiji Endoh, all of Yokohama, Japan

[73] Assignee: Asahi Glass Company, Ltd., Tokyo, Japan

[21] Appl. No.: 150,587

[22] Filed: May 16, 1980

Related U.S. Application Data

[63] Continuation-in-part of Ser. No. 10,257, Feb. 6, 1979, abandoned.

[30] Foreign Application Priority Data

Feb. 24, 1978 [JP] Japan ..... 53-19925

[51] Int. Cl.[3] ..... C25D 15/00; C25B 11/03; C25B 11/04

[52] U.S. Cl. ..... 204/16; 204/40; 204/290 R; 204/292

[58] Field of Search ..... 204/16, 280, 292, 40, 204/290 R, 293

[56] References Cited

U.S. PATENT DOCUMENTS

| | | | |
|---|---|---|---|
| 4,024,044 | 5/1977 | Brannan | 204/242 |
| 4,170,536 | 10/1979 | Kawasaki | 204/290 R |

FOREIGN PATENT DOCUMENTS

| | | | |
|---|---|---|---|
| 1952915 | 4/1971 | Fed. Rep. of Germany | 204/16 |
| 2449603 | 5/1976 | Fed. Rep. of Germany | 204/16 |
| 1070343 | 6/1967 | United Kingdom | 204/16 |
| 1148865 | 4/1969 | United Kingdom | 204/16 |
| 1347184 | 2/1974 | United Kingdom | 204/16 |
| 324301 | 6/1972 | U.S.S.R. | 204/16 |

*Primary Examiner*—T. M. Tufariello

*Attorney, Agent, or Firm*—Oblon, Fisher, Spivak, McClelland & Maier

[57] ABSTRACT

An electrode is prepared by plating on an electrode substrate in a dispersion coating method to form a metal layer partially exposed porous particles of Ag on the electrode substrate, and, if desired, a middle layer is formed between the electrode substrate and the metal layer. The porous particles can be formed by etching an alloy of the particles.

15 Claims, 4 Drawing Figures

PROCESS FOR PREPARING ELECTRODE

CROSS REFERENCE TO RELATED APPLICATIONS

This application is a continuation-in-part of application Ser. No. 010,257 filed Feb. 6, 1979, now abandoned.

BACKGROUND OF THE INVENTION

Field of the Invention

The present invention relates to an electrode which is used in an electrolysis of an aqueous solution in low overvoltage. More particularly, it relates to a cathode having low hydrogen overvoltage.

DESCRIPTION OF THE PRIOR ARTS

Various anticorrosive electrodes have been used in electrolysis of aqueous solution to obtain an electrolyzed products such as electrolysis of an aqueous solution of an alkali metal chloride to obtain an alkali metal hydroxide and chlorine.

When an overvoltage of the electrode caused in an electrolysis of an aqueous solution such as an aqueous solution of alkali metal chloride is lowered, the electric power consumption can be reduced and the electrolyzed product can be obtained at low cost.

In order to reduce a chlorine overvoltage of an anode, various studies have been made on the materials of the substrate and the treatments. Some of them have been practically employed.

It has been needed to use an electrode having a low hydrogen overvoltage and an anticorrosive characteristic since the diaphragm method for an electrolysis using a diaphragm has been developed.

In the conventional electrolysis of an aqueous solution of an alkali metal chloride using an asbestos diaphragm, iron mesh has been used as a cathode.

It has been proposed to treat a surface of an iron substrate by a sand blast treatment in order to reduce a hydrogen overvoltage if the iron substrate (for example, Surface Treatment Handbook Page 541 to 542 (Sangyotosho) by Sakae Tajima). However, the asbestos diaphragm method has disadvantageous of a low concentration of sodium hydroxide as about 10 to 13 wt.% and a contamination of sodium chloride in an aqueous solution of sodium hydroxide. Accordingly, the electrolysis of an aqueous solution of an alkali metal chloride using an ion exchange membrane as a diaphragm has been studied, developed and practically used.

In accordance with the latter method, an aqueous solution of sodium hydroxide having high concentration of 25 to 40 wt.% may be obtained. When the iron substrate is used as a cathode in the electrolysis, the iron substrate is broken by stress corrosion cracking or a part of the iron substrate is dissolved in a catholyte because of high concentration of sodium hydroxide and high temperature such as 80° C. to 120° C. in an electrolysis.

SUMMARY OF THE INVENTION

It is an object of the present invention to provide an electrode which is anticorrosive to an alkali metal hydroxide and which reduces effectively hydrogen overvoltage for a long time in an electrolysis.

The foregoing and other objects of the present invention have been attained by providing an electrode comprising a metal layer containing exposed particles of Ag formed on an electrode substrate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

DETAILED DESCRIPTION OF THE PREFERRED EMBODIMENTS

Figure 1:
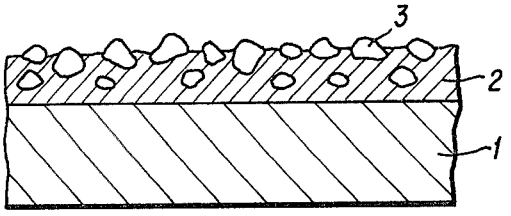
FIG. 1 is a sectional view of the surface of the electrode of the present invention.

On the surface of the electrode of the present invention, many particles of Ag are bonded to form porous layer.

The electrode of the present invention comprises many exposed particles of Ag having low hydrogen overvoltage on the surface of the electrode to form a fine porous condition of the surface, whereby activity of the electrode is high and the hydrogen overvoltage of the electrode can be effectively reduced by synergistic effect.

The exposed particles of Ag are firmly bonded in the metal layer formed on the electrode substrate whereby they are not deteriorated to prolong remarkably the maintenance of the low hydrogen overvoltage.

The electrode substrate can be made of suitable electric conductive metal such as Ti, Zr, Fe, Ni, V, Mo, Cu, Ag, Mn, platinum group metals, graphite and Cr and alloys thereof and preferably Fe and Fe-alloys (Fe-Ni alloy, Fe-Cr alloy and Fe-Ni-Cr alloy), Ni and Ni-alloys (Ni-Cu alloy and Ni-Cr alloy), Cu and Cu-alloys, and especially Fe, Cu, Ni, Fe-Ni alloys and Fe-Ni-Cr- alloys.

The structure of the electrode substrate can have a size suitable for the electrode.

The shape of the electrode can be plate, porous and net (expand metal) or parallel screen shape which can be flat, curved or cylindrical.

The exposed particles of Ag can be made of the metal itself or an alloy having the metal as main component or a composite of the metal or the alloy.

When the composite or the alloy having said metal as the main component is used, a metal which does not substantially adversely affect to reduce the hydrogen overvoltage such as Al, Zn, Mg, Si, Sb or Sn though it is depending upon a content of the additional metal.

The average particle size of the particles is usually in a range of 0.1 to 100$\mu$ though it is depending upon a dispersibility of the particles. From the viewpoint of porosity on the surface of the electrode, the average particle size is preferably in a range of 0.9 to 50$\mu$ especially 1 to 30$\mu$.

The particles are preferably porous on their surfaces so as to give lower hydrogen overvoltage.

The terminology of porous on their surfaces means to be porous on the surface exposed over the metal layer and does not mean to be porous on all of the surfaces of the particles.

It is preferable to be higher porosity, however excessive porosity causes low mechanical strength and accordingly, the porosity is preferably in a range of 35 to 85% especially 50 to 80%.

The porosity is measured by the conventional water substituting method.

Various methods have been employed for forming the porous surface such as a method of removing metals other than Ag from an alloy having Ag as the main component to form the porous surface; a method of converting Ag into carbonyl compound thereof and decomposing thermally the carbonyl compound to form the porous surface; a method of decomposing thermally an organic acid salt of Ag to form the porous surface; and a method of heating an oxide of Ag in hydrogen reducing atmosphere to form the porous surface.

From the viewpoint of a possibility, it is preferable to employ the method of removing metals other than Ag from an alloy having Ag as the main component. In such method, the particles are made of an alloy comprising the first type metal component of Ag and the second type metal component selected from the group consisting of Al, Zn, Mg, Si, Sb and Sn and at least part of the second type metal component is removed from the alloy.

Examples of such alloys include Ag-Al alloys, Ag-Zn alloys, Ag-Mg alloys and Ag-Sn alloys.

From the viewpoint of easy availability, it is preferable to use Ag-Al alloys such as unleached Raney silver.

The metals of the metal layer for bonding the particles are metals having high alkali resistance and bonding firmly the particles and preferably selected from the group consisting of Ni, Co and Ag, especially the metal same with the metal as the main component of the particles.

The thickness of the metal layer is ranging 20 to 200$\mu$ preferably 25 to 150$\mu$, especially 30 to 100$\mu$ since the particles are bonded in the metal layer on the electrode substrate under burying partially in the metal layer.

FIG. 1 shows a sectional view of the surface of the electrode of the present invention to be easily understood.

As shown in FIG. 1, the metal layer (2) is formed on an electrode substrate (1) and particles (3) are firmly bonded in the metal layer so as to expose parts of the particles above the metal layer.

A content of the particles in the metal layer (2) is ranging 5 to 80 wt.%, preferably 10 to 50 wt.%.

It is also preferable to form a middle layer made of a metal selected from the group consisting of Ni, Co, Ag and Cu between the electrode substrate and the metal layer containing the particles whereby a durability of the electrode is improved.

Such middle layer can be made of the same or different metal of the metal layer and is preferably made of the same metal from the viewpoint of the bonding strength to the metal layer.

A thickness of the middle layer is ranging 5 to 100$\mu$ preferably 20 to 80$\mu$ especially 30 to 50$\mu$.

Figure 2:
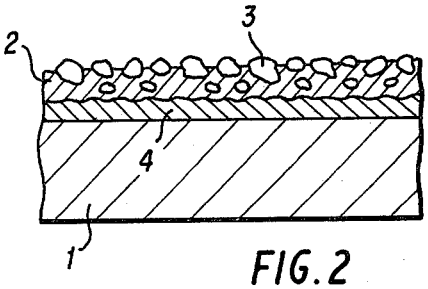
FIG. 2 is a sectional view of the present electrode having an intermediate layer.

FIG. 2 is a sectional view of an electrode having the middle layer as the schematic view to be easily understood.

In FIG. 2, the electrode comprises the electrode substrate (1), the middle layer (4), the metal layer (2) containing particles and the particles (3).

Many particles are exposed on the surface of the electrode in macro but the surface of the particles is porous in micro.

The degree of the porosity relates to the reduction of hydrogen overvoltage and is satisfactory more than 1000 $\mu F/cm^2$ as an electrical double layer capacity (a value of a double-layer capacity) and preferably more than 2000 $\mu F/cm^2$ especially more than 5000 $\mu F/cm^2$.

The electrical double layer capacity is electrostatic capacity of electric double layer formed by distributing relatively positive and negative ions with short distance near the surface of the electrode when dipping the electrode in an electrolyte and it is measured as differential capacity.

The capacity is increased depending upon increasing specific surface of the electrode. Thus, the electrical double layer capacity of the surface of the electrode is increased depending upon increasing an porosity of the surface and a surface area of the electrode. The electrochemically effective surface area of the electrode that is the porosity of the surface of the electrode can be considered by the electrical double layer capacity.

The electrical double layer capacity is varied depending upon the temperature at the measurement and the kind and concentration of the electrolyte, and on the potential and the electrical double layer capacity in the specification means values measured by the following method.

A test piece (electrode) was immersed in an aqueous solution of 40 wt.% of NaOH at 25° C. and a platinum electrode having platinum black coat (platinized platinum plate) having a specific area of about 100 times of the area of the test piece is immersed as a pair of electrodes and a cell-impedance in the condition is measured by Kohlarausch bridge to obtain an electrical double layer capacity.

Various methods for coating the surface layer on the electrode for example, a dispersion coating method, a melt spraying method etc. can be employed.

The dispersion coating method is especially preferable since the particles can be bonded in the metal layer in the present invention.

In the dispersion coating method, the particles are suspended in the plating bath in which electroplating is carried out and they are codeposited on the substrate with the plated metal.

In order to maintain the dispersing condition, various methods such as a mechanical stirring method, an air mixing method, a liquid circulating method, an ultrasonic vibrating method and a fluidized bed method can be employed.

When the dispersion coating method is employed by using conductive particles, the electrodeposited material is dendritic and has low strength as disclosed in R. Bazzard, Trans, Inst. Metal Finishing, 1972, 50 63; J. Foster et al, ibid, 1976, 54 178).

It has been found, in accordance with detailed studies on the dispersion coating method, that the electrodeposited material is dendritic and has relatively low strength when a stirring is not vigorous whereas the electrodeposited material is not substantially dendritic and has high strength and hydrogen overvoltage is low enough when a stirring is vigorous. When the stirring is too vigorous, an amount of the codeposition of the particles is decreased to form a smooth electrodeposition and the hydrogen overvoltage is high though the strength of the metal layer and the bonding strength are high enough.

It has been found that the hydrogen overvoltage, strength and shape of the electrodeposition in the dispersion coating method are highly related with a condition of the dispersion.

In a preparation of an industrial size electrode, if non-uniform codeposition is partially formed, hydrogen overvoltage is low to increase current at parts of much codeposition whereas hydrogen overvoltage is high to decrease current at parts of less codeposition. The current line distribution is highly disturbed disadvantageously.

It is important to codeposite uniformly that is to carry out a dispersion coating under a uniform stirring condition.

Various uniform codeposition method have been studied. As the result, it has been found that a dispersion coating method of coating under vertically vibrating a perforated plate at a lower part in a plating bath vessel is preferable. It has been found that a method of stirring uniformly the plating bath by injecting an inert gas such as $N_2$ gas or a reducing gas such as $H_2$ gas into a plating bath vessel is further preferable.

As the result of the studies on a method of stirring uniformly a plating bath by recycling it, it has been found that a plating method by flowing a plating solution having dispersed particles from the lower part to the upper part at a coated plate disposed between a pair of anodes is also preferable. In such case, it is further preferable to stir the bath under injecting an inert gas or a reducing gas.

When a silver layer is formed as a metal layer, it is possible to use a silver plating bath (Ag CN 36 g/liter; KCN 60 g/liter and $K_2CO_3$ 15 g/liter).

It is preferable to use the above-mentioned bath, however the bath is not critical and various silver plating baths can be used.

Particles containing a metal of Ag are dispersed in said plating bath. The kind and size of the particles are discribed above.

Particles containing a metal selected from Ni, Co or Ag are dispersed in said plating bath. The kind and size of the particles are discribed above.

When an alloy made of the first metal of Ag and the second metal of Al, Zn, Mg, Si, Sb or Sn is used, as the particles it is preferable to treat the particles with an alkali metal hydroxide as described below. The alloy is preferably the unleached Raney silver as described.

The particles can be made of the first metal only or the particles of an alloy of the first metal and second metal from which a part of the second metal is removed. In such case, it is unnecessary to treat the particles with an alkali metal hydroxide. Such alloy can be a leached Raney silver.

In such case, it is preferable to form partially oxide layer on the surface of the particles to stabilize the surface from the viewpoint of handling. In particular, a commercially available stabilized Raney silver can be used.

The oxide coating on the particles may be removed under reducing the oxide with hydrogen generated when the electrode is used as a cathode in an electrolysis of an aqueous solution of an alkali metal chloride. The oxide coating may be removed by reducing it, before using the electrode, (for example, heating the electrode in hydrogen).

A concentration of the particles in the bath is preferably in a range of 1 g/liter to 200 g/liter from the viewpoint of improvement of bonding the particles on the surface of the electrode. A temperature condition in the dispersion coating method is preferably in a range of 20° C. to 80° C. and a current density is preferably in a range of 1 A/dm$^2$ to 20 A/dm$^2$.

It is possible to add a desired additive for reducing strain or a desired additive for improving a codeposition in the plating bath.

It is also possible to heat or to repeat a nickel plating after the dispersion coating in order to improve the bonding property between the particles and the metal layer.

As described, when the middle layer is formed between the electrode substrate and the metal layer containing the particles, the electrode substrate is firstly coated by a nickel plating, a cobalt plating, a silver plating or a copper plating and then, the metal layer containing the particles is formed on the middle layer by a dispersion coating method or a melt spraying method.

In the formation of the middle layer, various plating bath can be used and the conventional copper plating baths can be also used.

Thus, the electrode having the particles coated through the metal layer on the electrode substrate can be obtained.

Thus, if desired, the resulting electrode is treated with an alkali metal hydroxide (for example, an aqueous solution of an alkali metal hydroxide) to remove at least part of the metal component other than Ag in the alloy of the particles.

In the treatment, a concentration of an aqueous solution of an alkali metal hydroxide as NaOH is preferably in a range of 5 to 40 wt.% and a temperature is preferable at 50° C. to 150° C.

When the particles made of the alloy of the first metal and the second metal are used, it is preferable to carry out the alkali metal hydroxide treatment, however it is possible to carry out an electrolysis of an alkali metal chloride in an electrolytic cell equipped with the electrode. Thus, the second metal component is dissolved during the electrolysis, to decrease the hydrogen overvoltage of the electrode though the resulting aqueous solution of an alkali metal hydroxide is slightly contaminated with the second metal ions formed by the dissolution.

The electrode of the present invention can be used as an electrode especially a cathode for an electrolysis of an aqueous solution of an alkali metal chloride in an ion exchange membrane process, and it can be also used as an electrode for an electrolysis of an aqueous solution of an alkali metal chloride or an electrolysis of water with a porous diaphragm such as asbestos diaphragm.

The present invention will be further illustrated by certain examples and references which are provided for purposes of illustration only and are not intended to be limiting the present invention.

EXAMPLE 1

Powdery leached Raney silver was dispersed into a silver bath (AgCN 100 g/liter; KCN 100 g/liter; $K_2CO_3$ 15 g/liter; KOH 3 g/liter) at the concentration of 100 g/liter and a silver plate was used as an anode and a copper plate was used as a cathode and a plating was carried out under a condition of a current density of 6 A/dm$^2$ at 50° C. for 60 minutes.

The silver plated layer had a thickness of about 190$\mu$ and the content of Raney silver particles in the silver plated layer was about 35 wt.%. The resulting plated silver layer had an electrical double layer capacity of 4000 $\mu$F/cm$^2$. The electrical double layer capacity was measured as follows.

A test piece and a platinum plate coated with platinum black having a specific surface area of 100 times of the surface area of the piece were immersed in an aqueous solution of NaOH of 40% at 25° C., forming a pair of electrode. The cell-impedance was measured with the Kohlarausch bridge and then the electrical double layer capacity of the test piece was calculated from it.

An electrode potential of the plated silver plate as a cathode versus a saturated caromel electrode as a reference electrode was measured in 40 wt.% aqueous solution of NaOH at 90° C. and 20 A/dm$^2$.

As the result, a hydrogen voltage was 130 mV under the condition described above.

EXAMPLE 2

Figure 3:
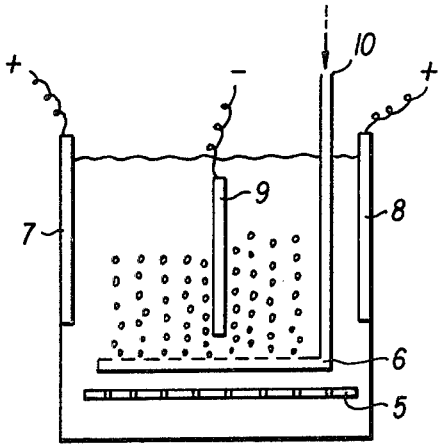
FIG. 3 shows an electrical plating vessel.

Powdery leached Raney silver was dispersed into a silver bath (AgCN 100 g/liter; KCN 100 g/liter; $K_2CO_3$ 15 g/liter; KOH 3 g/liter) at the concentration of 200 g/liter. The resulting dispersion was charged into an electrical plating vessel of FIG. 3 wherein a perforated plate (5) was vertically moved at the lower part of the vessel and nitrogen gas was downwardly injected through a bubbler (6) and a plate (9) for plating was disposed between a pair of silver electrodes (7), (8) having substantially same area. The perforated plate was moved at a stroke of about 20% to the height of the bath at 100 Hz/min. and the nitrogen gas was injected at a rate of 10 liter/min. dm$^2$ of the area of the bottom of the vessel. The plate (9) for coating as a cathode (an electrode substrate) was an copper expand metal. The plating was carried out at 50° C. under a current density of 6 A/dm$^2$ for 1 hour to form a grayish black layer wherein a thickness of the plated nickel layer was about 220$\mu$ and a content of the leached Raney silver particles in the plated silver layer was about 45 wt.%. The plated silver layer was uniform in whole parts. The resulting plated silver layer had an electrical double layer capacity of 7500 $\mu$F/cm$^2$ and a hydrogen overvoltage of 110 mV under the condition of Example 1.

EXAMPLE 3

Figure 4:
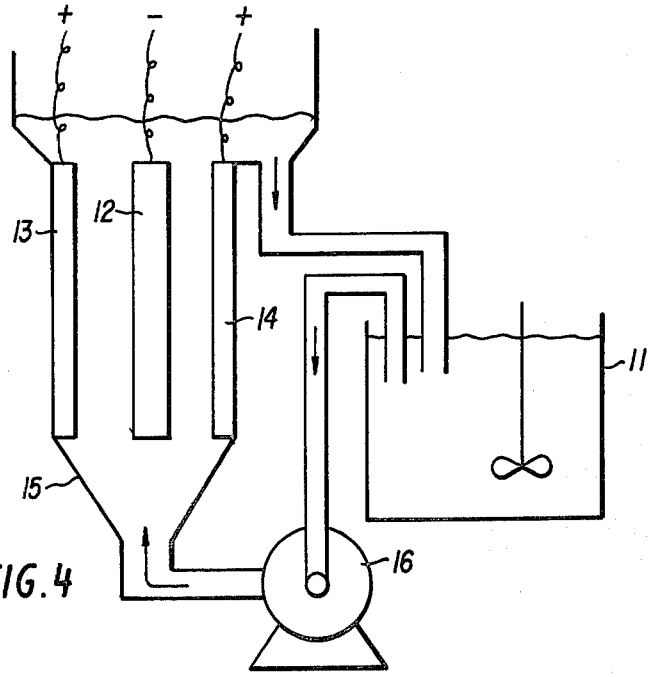
FIG. 4 shows another electrical plating vessel.

Powdery leached Raney silver was dispersed into a silver bath (AgCN 40 g/liter; KCN 60 g/liter; $K_2CO_3$ 15 g/liter; KOH 2 g/liter) at a concentration of 100 g/liter. The dispersion was fed into a plating vessel (11) shown in FIG. 4 wherein an copper plate (12) for plating was disposed between a pair of silver anodes (13), (14) having substantially same area and a plating was carried out under recycling the dispersion at 50° C. at a linear flow rate of 70 cm/sec. in the vessel by a pump under a current density of 6 A/dm$^2$ for 60 minutes. A gravish black layer was formed and a thickness of the plated nickel layer was about 180$\mu$ and a content of the leached Raney silver in the silver layer was about 32 wt.%. The plated silver layer was uniform in whole parts. The resulting plated silver layer had an electrical double layer capacity of 5000 $\mu$F/cm$^2$ and a hydrogen overvoltage of 130 mV under the condition of Example 1.

EXAMPLE 4

A saturated aqueous solution of sodium chloride was electrolyzed for 100 days with an electrolytic cell which comprises a cathode obtained in Example 1, an anode (titanium coated with titanium oxide and ruthenium oxide) and a cation permeable membrane made of a fluorinated polymer ("Nafion" manufactured by E. I. DuPont) disposed between those two electrodes.

Electrolyzing condition was as follows:

catholyte: 40% NaOH
current density: 20 A/dm$^2$
cell temperature: 90° C.

A hydrogen overvoltage of this cathode measured after the above-mentioned operation was the same as the initial value, i.e. 130 mV and neither a plated layer nor a plated particle was peeled off.

What is claimed is:

1. An electrode which comprises a metal layer of silver bonded to a metallic electrode substrate, which metal layer contains partially exposed particles comprising silver, the content of the particles in the metal layer ranging from 5 to 80 wt.%.

2. An electrode according to claim 1 wherein the electrical double layer capacity of the surface of said electrode is greater than 1000 $\mu$F/cm$^2$.

3. An electrode according to claim 1 wherein the proportion of the particles in the metal layer is from 5 to 80 wt.%.

4. An electrode according to claim 1 wherein a middle layer of at least one metal selected from the group consisting of nickel, cobalt, silver and copper is formed between the electrode substrate and the metal layer containing the particles.

5. An electrode according to claim 1 wherein the particles are formed by removing at least part of a second metal component from particles made of an alloy of Ag and the second metal component, the second metal being selected from the group consisting of Al, Zn, Mg, Si, Sb and Sn.

6. An electrode according to claim 1 or 5 wherein the particles are made of leached Raney silver.

7. An electrode according to claim 1 wherein the electrode is used as a cathode for the electrolysis of an aqueous solution of an alkali metal chloride in a diaphragm process or an ion-exchange membrane process.

8. A process for preparing an electrode which comprises bonding partially exposed particles comprising Ag to a metal layer of Ag which is bonded to a metallic electrode substrate, the content of the particles in the metal layer ranging from 5 to 80 wt.%.

9. A process according to claim 8 wherein the particles and the metal layer are bonded to the electrode substrate by a dispersion coating method.

10. A process according to claim 8 or 9 wherein the particles are formed by removing at least part of a second metal component from particles made of an alloy of Ag and the second metal component, the second metal being selected from the group consisting of Al, Zn, Mg, Si, Sb, and Sn.

11. A process according to claim 8 wherein particles made of an alloy of Ag and a second metal component selected from the group consisting of Al, Zn, Mg, Si, Sb and Sn are bonded to the metal layer of Ag on the electrode substrate, and treated with an alkaline solution to dissolve at least part of the second metal component from the particles.

12. A process according to claim 9 wherein the dispersion is uniformly dispersed by moving vertically a perforated plate at a lower part of a plating vessel in the dispersion coating method.

13. A process according to claim 9 wherein the dispersion is uniformly dispersed by feeding the dispersion containing the particles into a plating vessel in the dispersion coating method.

14. A process according to claim 12 wherein a gas is bubbled from the bottom of the plating vessel in the dispersion coating method.

15. A process according to claim 14 wherein the gas is an inert gas or a reducing gas.

* * * * *